US007820133B2

(12) United States Patent
Chen et al.

(10) Patent No.: US 7,820,133 B2
(45) **Date of Patent: *Oct. 26, 2010**

(54) LASER-BASED METHOD FOR GROWING ARRAY OF CARBON NANOTUBES

(75) Inventors: Zhuo Chen, Beijing (CN); Chun-Xiang Luo, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 412 days.

This patent is subject to a terminal disclaimer.

(21) Appl. No.: 11/982,489

(22) Filed: Nov. 2, 2007

(65) Prior Publication Data

US 2008/0159945 A1 Jul. 3, 2008

(30) Foreign Application Priority Data

Dec. 27, 2006 (CN) ..... 2006 1 0157768

(51) Int. Cl.
*D01C 5/00* (2006.01)

(52) U.S. Cl. ..... 423/447.3; 423/445 B; 977/742; 977/843

(58) Field of Classification Search ... 423/447.1–447.3, 423/445 B; 977/742, 842
See application file for complete search history.

(56) References Cited

U.S. PATENT DOCUMENTS 6,440,763 B1 * 8/2002 Hsu ..... 438/20
6,887,451 B2 * 5/2005 Dodelet et al. ..... 423/447.3
6,917,058 B2 * 7/2005 Niigaki et al. ..... 257/103
6,986,876 B2 * 1/2006 Smalley et al. ..... 423/447.1
7,357,691 B2 4/2008 Liu et al.
7,448,931 B2 11/2008 Liu et al.
2003/0130114 A1 * 7/2003 Hampden-Smith et al. .. 502/180
2004/0209385 A1 10/2004 Liu et al.
2005/0000438 A1 * 1/2005 Lim et al. ..... 118/722
2005/0052127 A1 * 3/2005 Sakata et al. ..... 313/506
2006/0263524 A1 11/2006 Jiang et al.

OTHER PUBLICATIONS

Carbon nanotube films grown by laser-assisted chemical vapor deposition F. Rohmund, R.-E. Morjan, G. Ledoux, F. Huisken, and R. Alexandrescu, J. Vac. Sci. Technol. B 20, 802 (2002), DO1:10.1116/1.1469013.*

Kinghong Kwok, Wilson K.S. Chiu. "Growth of carbon nanotubes by open-air laser-induced chemical vapor deposition". Carbon, 2005, vol. 43, p. 437-446.

* cited by examiner

*Primary Examiner*—Stuart Hendrickson
*Assistant Examiner*—Richard M Rump
(74) *Attorney, Agent, or Firm*—Jeffrey T. Knapp

(57) ABSTRACT

A method for growing an array of carbon nanotubes includes the steps of: (a) providing a substrate having a first surface and a second surface opposite to the first surface; (b) forming a catalyst film on the first surface of the substrate; (c) flowing a mixture of a carrier gas and a carbon source gas over the catalyst film; (d) providing a semiconductor laser system to generate a focused laser beam; and (e) irradiating the focused laser beam on the substrate to grow an array of carbon nanotubes on the substrate.

12 Claims, 4 Drawing Sheets

LASER-BASED METHOD FOR GROWING ARRAY OF CARBON NANOTUBES

RELATED APPLICATIONS

This application is related to commonly-assigned applications entitled, "LASER-BASED METHOD FOR MAKING FIELD EMISSION CATHODE", filed Nov. 2, 2007 U.S. application Ser. No. 11/982,674; "LASER-BASED METHOD FOR MAKING FIELD EMISSION CATHODE", filed Nov. 2, 2007 U.S. application Ser. No. 11/982,486; "LASER-BASED METHOD FOR GROWING AN ARRAY OF CARBON NANOTUBES", filed Nov. 2, 2007 U.S. application Ser. No. 11/982,485; "LASER-BASED METHOD FOR GROWING AN ARRAY OF CARBON NANOTUBES", filed Nov. 2, 2007 U.S. application Ser. No. 11/982,517; "LASER-BASED METHOD FOR GROWING AN ARRAY OF CARBON NANOTUBES", filed Nov. 2, 2007 U.S. application Ser. No. 11/982,667; and "LASER-BASED METHOD FOR GROWING AN ARRAY OF CARBON NANOTUBES", filed Nov. 2, 2007 U.S. application Ser. No. 11/982,669. Disclosures of the above-identified applications are incorporated herein by reference.

BACKGROUND

1. Field of the Invention

The invention relates generally to methods for growing carbon nanotubes and, particularly, to a laser-based method for growing an array of carbon nanotubes.

2. Discussion of Related Art

Carbon nanotubes (CNTs) produced by means of arc discharge between graphite rods were first discovered and reported in an article by Sumio Iijima, entitled "Helical Microtubules of Graphitic Carbon" (Nature, Vol. 354, Nov. 7, 1991, pp. 56-58). CNTs are electrically conductive along their length, chemically stable, and capable, individually, of having a very small diameter (much less than 100 nanometers) and large aspect ratios (length/diameter). Due to these and other properties, it has been suggested that CNTs can play an important role in various fields, such as microscopic electronics, field emission devices, thermal interface materials, etc.

Generally, there are three conventional methods for manufacturing CNTs. The first method is the arc discharge method, which was first discovered and reported in an article by Sumio Iijima entitled "Helical Microtubules of Graphitic Carbon" (Nature, Vol. 354, Nov. 7, 1991, pp. 56-58). The second method is the laser ablation method, which was reported in an article, by T. W. Ebbesen et al., entitled "Large-scale Synthesis of Carbon Nanotubes" (Nature, Vol. 358, 1992, pp. 220). The third method is the chemical vapor deposition (CVD) method, which was reported in an article by W. Z. Li entitled "Large-scale Synthesis of Aligned Carbon Nanotubes" (Science, Vol. 274, 1996, pp. 1701). The CVD method is advantageously useful in synthesis of an array of carbon nanotubes and is beneficial in mass production, improved length controllability, compatibility with conventional integrated circuit process, etc.

Generally, mainly three CVD methods, i.e. the thermal CVD, plasma-enhanced CVD, and laser-induced CVD, have been developed for the synthesis of arrays of carbon nanotubes. In conventional laser-induced CVD method, an opaque substrate, such as silicon, is disposed with a catalyst in a closed reactor filled with reactant gases, and either an argon ion laser or CO2 laser is employed to directly irradiate laser light on the substrate to heat the substrate to a reaction temperature. By locally laser-heating the substrate, carbon nanotubes can be synthesized on the substrate.

The conventional laser-induced CVD method for growing carbon nanotubes usually uses solid-state lasers or gas lasers. The solid-state lasers include neodymium-doped yttrium aluminum garnet (Nd: YAG) lasers or argon ion lasers, etc. The gas lasers include CO2 lasers, etc. However, the above-described lasers generally have a large size and high demands on the environment. Further, these lasers generally need an additionally cooling system, a temperature control system, an expensive power supply, a good shockproof system and optical systems, etc. Therefore, these lasers will be restricted to be applied in the laser-induced CVD method for growing carbon nanotubes.

In addition, the above-described laser-induced CVD method is performed in a closed reactor filled with reactant gases. Thus, the above-described method requires a complicated reaction device, and it is difficult to build and/or maintain a huge reactor device for CVD growth of carbon nanotubes on a large area substrate.

Comparing with the above-described solid-state lasers and gas lasers, conventional semiconductor lasers generally have the following advantages. Firstly, the semiconductor lasers only need an ordinary heatsink to disperse heat without an additionally cooling system. Secondly, the semiconductor lasers is simple equipment and can be conveniently used without a temperature control. Thirdly, the semiconductor lasers only require an ordinarily constant current source, and do not need a good shockproof system and optical systems. Therefore, the semiconductor lasers have a smaller size and lower cost than the solid-state lasers and gas lasers. However, the conventional laser-induced CVD method of growing carbon nanotubes do not use semiconductor lasers.

What is needed, therefore, is a laser-induced method for growing an array of carbon nanotubes that use semiconductor lasers.

SUMMARY

A method for growing array of carbon nanotubes includes the steps of: (a) providing a substrate having a first surface and a second surface opposite to the first surface; (b) forming a catalyst film on the first surface of the substrate; (c) flowing a mixture of a carrier gas and a carbon source gas over the catalyst film; (d) providing a semiconductor laser system to generate a focused laser beam; and (e) irradiating the focused laser beam on the substrate to grow an array of the carbon nanotubes on the substrate.

Other advantages and novel features of the present method for growing an array of carbon nanotubes will become more apparent from the following detailed description of presents embodiments when taken in conjunction with the accompanying drawings.

BRIEF DESCRIPTION OF THE DRAWINGS

Many aspects of the present method for growing an array of carbon nanotubes can be better understood with reference to the following drawings. The components in the drawings are not necessarily to scale, the emphasis instead being placed upon clearly illustrating the principles of the present method for growing an array of carbon nanotubes.

Figure 1:
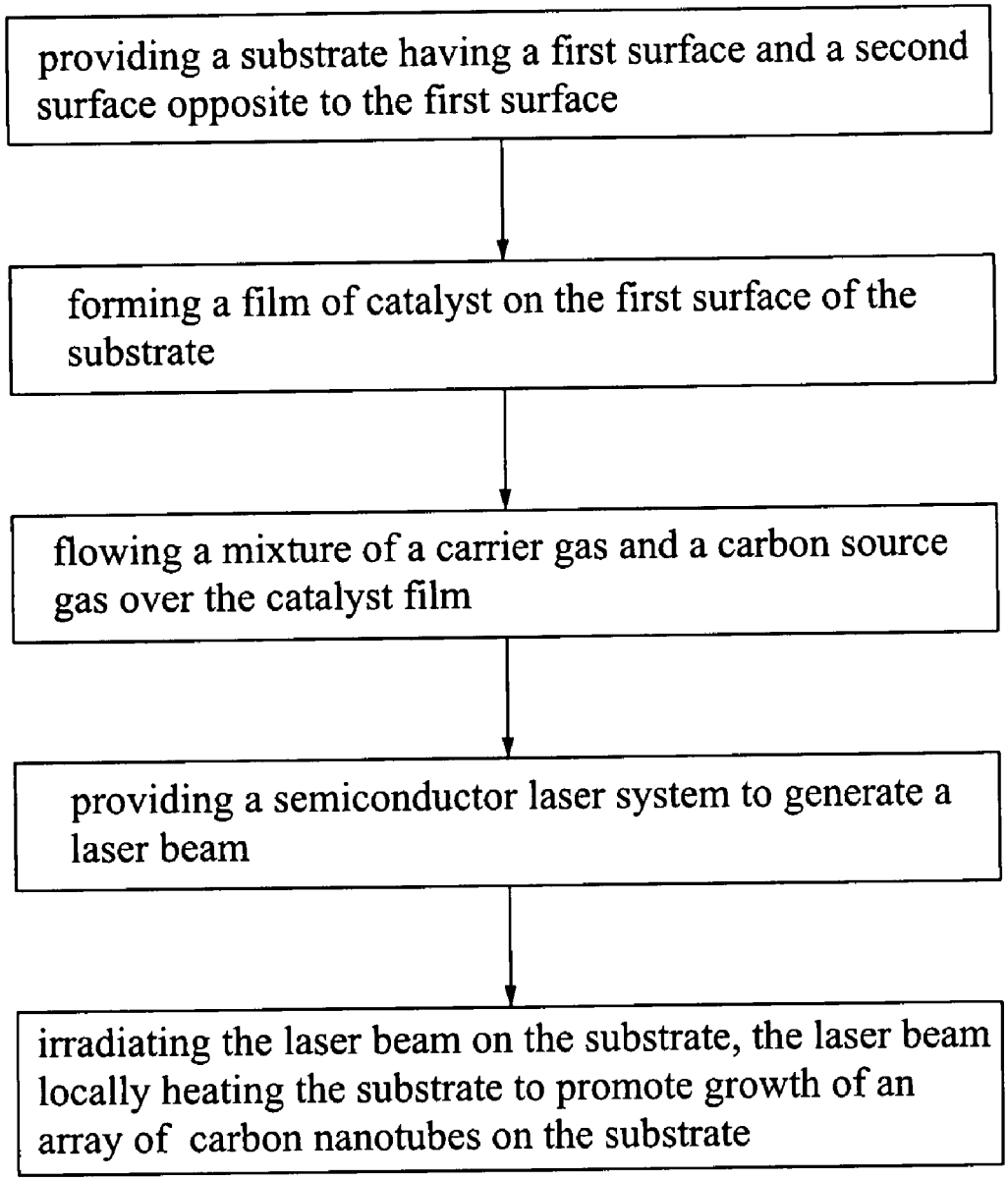
FIG. 1 is a flow chart of a method for growing an array of carbon nanotubes, in accordance with a present embodiment.

Corresponding reference characters indicate corresponding parts throughout the several views. The exemplifications set out herein illustrate at least one preferred embodiment of the present method for growing an array of carbon nanotubes, in at least one form, and such exemplifications are not to be construed as limiting the scope of the invention in any manner.

DETAILED DESCRIPTION OF PREFERRED EMBODIMENTS

Reference will now be made to the drawings to describe, in detail, embodiments of the present method for growing an array of carbon nanotubes.

Referring to FIG. 1, a method for growing/producing an array of carbon nanotubes includes the following steps: (a) providing a substrate having a first surface and a second surface opposite to the first surface; (b) forming a catalyst film on the first surface of the substrate, the catalyst film including a carbonaceous material (i.e., a carbon-carrying catalyst film); (c) flowing a mixture of a carrier gas and a carbon source gas across/over the catalyst film; (d) providing a semiconductor laser system to generate a focused laser beam; and (e) irradiating the focused laser beam on the substrate to grow an array of the carbon nanotubes from the substrate via the catalyst film.

In step (a), the substrate is, advantageously, made of a heat-resistant material (e.g., high-melting point, chemically durable), which can tolerate the high reaction temperature (e.g., upwards of about of 600° C.). It is to be understood that depending on different applications, the material of the substrate could be selected from opaque or transparent material, e.g. a group of opaque material consisting of silicon, silicon dioxide and a metal for semiconductor electronical devices; and a group of transparent material consisting of glass and plastic organic material for flat displays.

In step (b), the catalyst film can be uniformly disposed on the first surface of the substrate by means of thermal deposition, electron-beam deposition, or sputtering. The catalyst can be made of iron, gallium nitride, cobalt, nickel, or any combination alloy thereof. The step (b) can further include forming oxide catalyst particles through such means as high-temperature annealing.

In step (b), the catalyst film includes the first carbonaceous material, or a step (f) of forming a light absorption layer is further provided before step (b), and the catalyst film is formed on the light absorption layer, which is disposed on the first surface of the substrate.

In step (b), when the catalyst film includes the first carbonaceous material, the method for making the catalyst film including the first carbonaceous material includes the substeps of: (b1) providing a mixture of a dispersant and a first carbonaceous material; (b2) mixing/combining the mixture with a solvent to form a solution; (b3) ultrasonically agitating the solution to promote dispersing of the first carbonaceous material therein; (b4) adding a soluble catalyst material into the dispersed solution to form a catalyst solution; (b5) coating the catalyst solution on the first surface of the substrate; and (b6) baking the substrate and forming thereon a catalyst film including the first carbonaceous material (i.e., a carbon-carrying catalyst film).

In step (b1), the first carbonaceous material can usefully be selected from carbon black (CB) and/or graphite. The dispersant is used for uniformly dispersing the first carbonaceous material. Quite suitably, the dispersant is sodium dodecyl benzene sulfonate (SDBS). A weight ratio of the dispersant to the first carbonaceous material is, advantageously, in the approximate range from 1:2 to 1:10. In step (b2), the solvent is, opportunely, water or ethanol. In one useful embodiment, SDBS of greater than about 0~100 mg (beneficially, a measurable amount of dispersant (i.e., above about 0 mg) is employed to) and CB of about 100~500 mg can be mixed into ethanol of about 10~100 ml to form the solution. Quite usefully, the solution is formed by mixing SDBS of about 50 mg and CB of about 150 mg into ethanol of about 40 ml.

In step (b3), the solution can be sonicated (i.e., subjected to ultrasound) for, e.g., about 5 to 30 minutes to uniformly disperse the first carbonaceous material in the solution. In step (b4), the soluble catalyst material can, rather approximately, include one or more metallic nitrate compounds selected from a group consisting of magnesium nitrate (Mg(NO3)2.6H2O), iron nitrate (Fe(NO3)3.9H2O), cobalt nitrate (Co(NO3)2.6H2O), nickel nitrate (Ni(NO3)2.6H2O), and any combination thereof. In one useful embodiment, after being treated with ultrasound for about 5 minutes, Fe(NO3)3.9H2O and Mg(NO3)2.6H2O is added to the solution, thereby forming the catalyst solution. Quite usefully, the catalyst solution includes about 0.01~0.5 Mol/L magnesium nitrate and about 0.01~0.5 Mol/L iron nitrate.

In step (b5), the catalyst solution is, beneficially, spin-coated on the substrate at a rotational speed of about 1000~5000 rpm. Quite suitably, the rotational speed for spin coating is about 1500 rpm. In step (b6), the substrate with the catalyst solution coated thereon is baked at about 60~100° C. for several tens of minutes (i.e., 10 min~1 hr). It is to be understood that the baking process is used to vaporize the solvent in the solution and accordingly form the carbon-carrying catalyst film on the first surface of the substrate.

In step (b), wherein a step (f) of forming a light absorption layer is further provided before step (b), and the catalyst film is formed on the light absorption layer, which is disposed on the first surface of the substrate. Wherein the step (f) further comprises the substeps of: (f1) applying a second carbonaceous material layer onto the first surface of the substrate; (f2) gradually heating the substrate with the second carbonaceous material layer to about 300~450° C. for a time within in a range of about 60~90 minutes in an atmosphere of N2 and/or another inert gas and baking the substrate with the second carbonaceous material for about 15~20 minutes; and (f3) cooling down the substrate with the second carbonaceous material thereon to room temperature and thereby forming/yielding a light absorption layer on the first surface of the substrate.

In step (f1), the second carbonaceous material layer can be made of materials having merits of good electrical conductivity, strong adhesion with the substrate, and compatibility with high vacuum environment, etc. Quite usefully, the second carbonaceous material is a commercially colloidal graphite inner coating (GIC), as used for CRTs. The second carbonaceous material can, beneficially, be spin-coated on the first surface of the substrate at a rotational speed of about 1000-5000 rpm. Quite suitably, the rotational speed for spin coating is about 1500 rpm. In step (f2), the baking process is, at least in part, used to eliminate any impurities in the second carbonaceous material layer, such as the macromolecule material in the GIC. The thickness of the formed light absorption layer is in the approximate range from 1 to 20 micrometers.

In step (b), wherein step (b) further comprises the steps of: (b7) providing a catalyst-ethanol solution; (b8) coating the catalyst-ethanol solution on the GIC layer to form the catalyst film.

In step (b7), the catalyst can, opportunely, be made of iron, gallium nitride, cobalt, nickel, or any combination alloy thereof. In step (b8), in one useful embodiment, a catalyst-ethanol solution is spin-coated (~1500 rpm) on the GIC layer to form the catalyst film. The catalyst-ethanol solution is a mixture solution of ethanol and one or more metallic nitrate compounds selected from a group consisting of magnesium nitrate ($Mg(NO3)2.6H2O$), iron nitrate ($Fe(NO3)3.9H2O$), cobalt nitrate ($Co(NO3)2.6H2O$), nickel nitrate ($Ni(NO3)2.6H2O$), and any combination thereof. Quite usefully, the catalyst-ethanol solution includes about 0.01~0.5 Mol/L magnesium nitrate and about 0.01~0.5 Mol/L iron nitrate. The thickness of the formed catalyst film is in the approximate range from 1 to 100 nanometers.

In step (c), a carbon source gas, which is combined with a carrier gas, is introduced as a gas flow over/across the catalyst film. The carbon source gas acts as a primary source of carbon for growing the carbon nanotubes. In one useful embodiment, the carbon source gas and the carrier gas, in open air, are directly introduced by a nozzle to an area adjacent to the catalyst film. That is, the method can be operated without a closed reactor and/or without being under a vacuum. The carrier gas can, beneficially, be nitrogen ($N2$) or a noble gas. The carbon source gas can, advantageously, be ethylene ($C2H4$), methane ($CH4$), acetylene ($C2H2$), ethane ($C2H6$), or any combination thereof. Quite suitably, the carrier gas is argon (Ar), and the carbon source gas is acetylene. A ratio of a carrier gas flow-rate to a carbon source gas flow-rate is, opportunely, adjusted to be in an approximate range from 5:1 to 10:1. Quite usefully, the argon flow-rate is 200 sccm (Standard Cubic Centimeter per Minute), and the acetylene flow-rate is 25 sccm.

Figure 2:
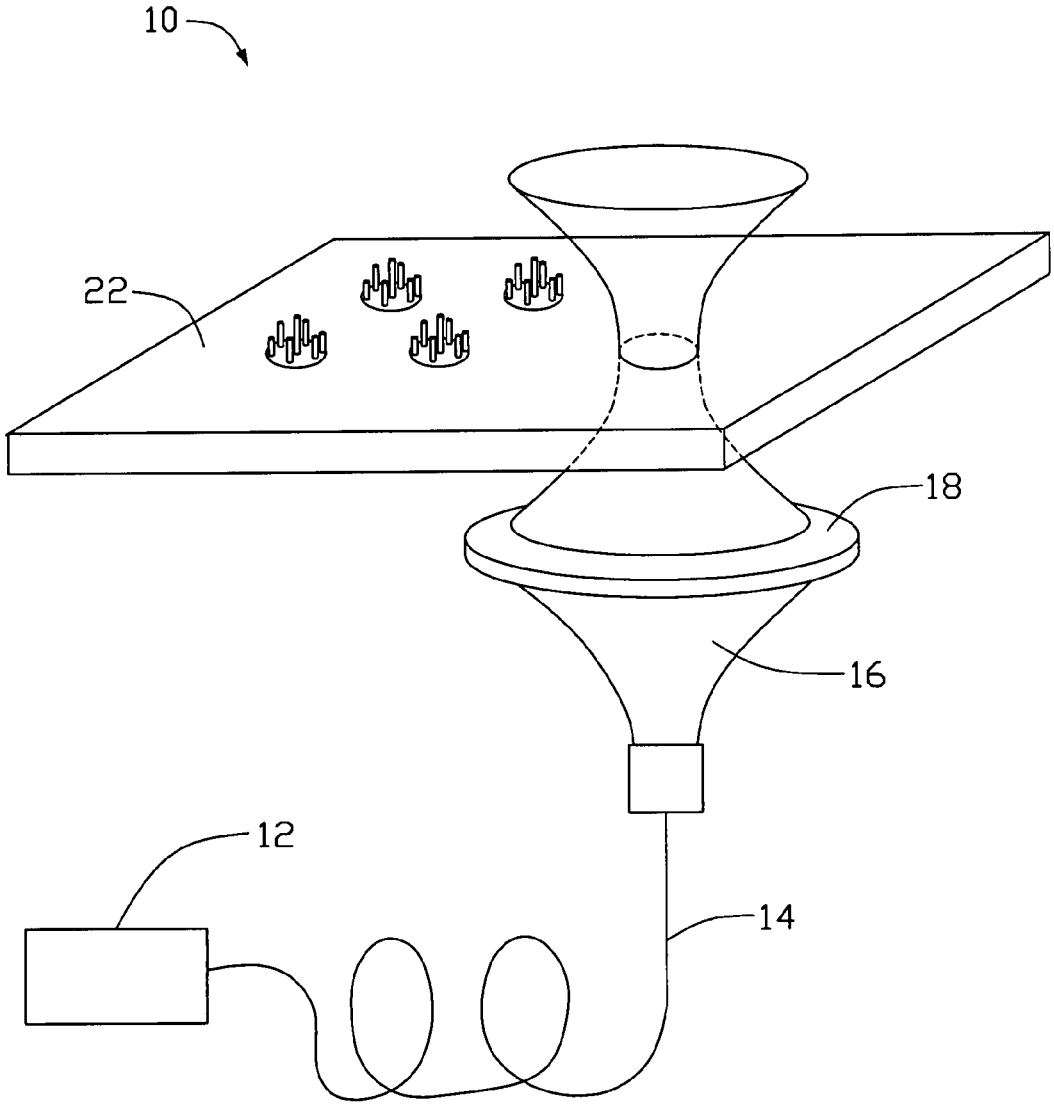
FIG. 2 is a schematic structure chart of an equipment using the present method for growing the array of carbon nanotubes in accordance with the present embodiment.

In step (d), the laser beams can be generated by a semiconductor laser system. The semiconductor laser system includes at least one laser diode, at least one multi-model optical fiber connecting to the laser diode, and at least one lens for focusing laser beams generated by the laser diode. Referring to FIG. 2, the multi-model optical fiber 14 has a first end and a second end opposite to the first end. The laser diode 12 is couplingly connected to the first end of the multi-model optical fiber 14. The laser beams 16 generated by the laser diode 12 emit from the second end of the multi-model optical fiber 14. The emitted laser beams 16 focused by the lens 18 irradiate on the substrate 22.

In one useful embodiment, a diameter of the multi-model optical fiber 14 is in the approximate range from 20 to 100 μm (micrometer). A power of the laser diode 12 is in the approximate range from above about 0 W (Watt) (i.e., a measurable amount of power) to 10 W. A wavelength of the laser beams 16 generated by the laser diode 12 is in the approximate range from 700 to 1300 nm (nanometer). Quite usefully, the power of the laser diode 12 used for generating the laser beams 16 is about 2 W. The wavelength of the laser beams 16 generated by the laser diode 12 is 808 nm. After coupling with the multi-model optical fiber 14, the laser beams 16 focused by the lens 18 irradiate on the substrate 22. A diameter of the focused laser beams 16 is in the approximate range from 50 to 200 μm (micrometer).

It is to be understood that the focused laser beams 16 could be employed to irradiate on the catalyst film directly or on the second surface of the substrate 22, when the substrate 22 is made of a transparent material and/or has a thin thickness. If the focused laser beams 16 irradiate on the second surface of the substrate 22, the laser energy can pass through the substrate 22 and heat the catalyst film.

In step (e), due to catalyzing by the catalyst film, the carbon source gas supplied over/across the catalyst film is pyrolyzed in a gas phase into carbon units (C═C or C) and free hydrogen ($H2$). The carbon units are absorbed on a free surface of the catalyst film and diffused thereinto. When the catalyst film becomes supersaturated with the dissolved carbon units, carbon nanotube growth is initiated. As the intrusion of the carbon units into the catalyst film continues, an array of carbon nanotubes is formed. The additional hydrogen produced by the pyrolyzed reaction can help reduce the catalyst oxide and thus activate the catalyst. As such, the growth speed of the carbon nanotubes is increased, and the achievable height of the array of the carbon nanotubes is enhanced.

It is noted that the catalyst film can be heated by laser irradiating. At the same time, the light absorption layer can absorb laser energy and further promote heating the catalyst film. Thus, the predetermined temperature for locally heating the catalyst film by laser beam can be less than ~600° C. Moreover, the present method can heat up the catalyst film to a predetermined reaction temperature within less time. Further, the carbon source gases are directly flowing over/across area near the catalyst film. As such, the predetermined reaction temperature and the concentration of the carbon source gases can achieve the requirements for CNTs growth in open air, without a closed reactor and/or vacuum conditions.

Because the present embodiments mainly use thermal effect of the laser beams 16, requirements for the laser optical effect are not high. The laser beams 16 generated by coupling the laser diode 12 with the multi-moldes optical fiber enhance the power of laser beams 16, and thus beneficially uniformly heat the catalyst film. Moreover, a wavelength of the laser beams 16 generated by the semiconductor lasers are shorter than that generated by the traditional gas lasers, and the laser beams 16 generated by the semiconductor lasers have a square-wave distribution. So the laser beams 16 generated by the semiconductor lasers are beneficial to quickly/rapidly heat the substrate and the catalyst.

Figure 3:
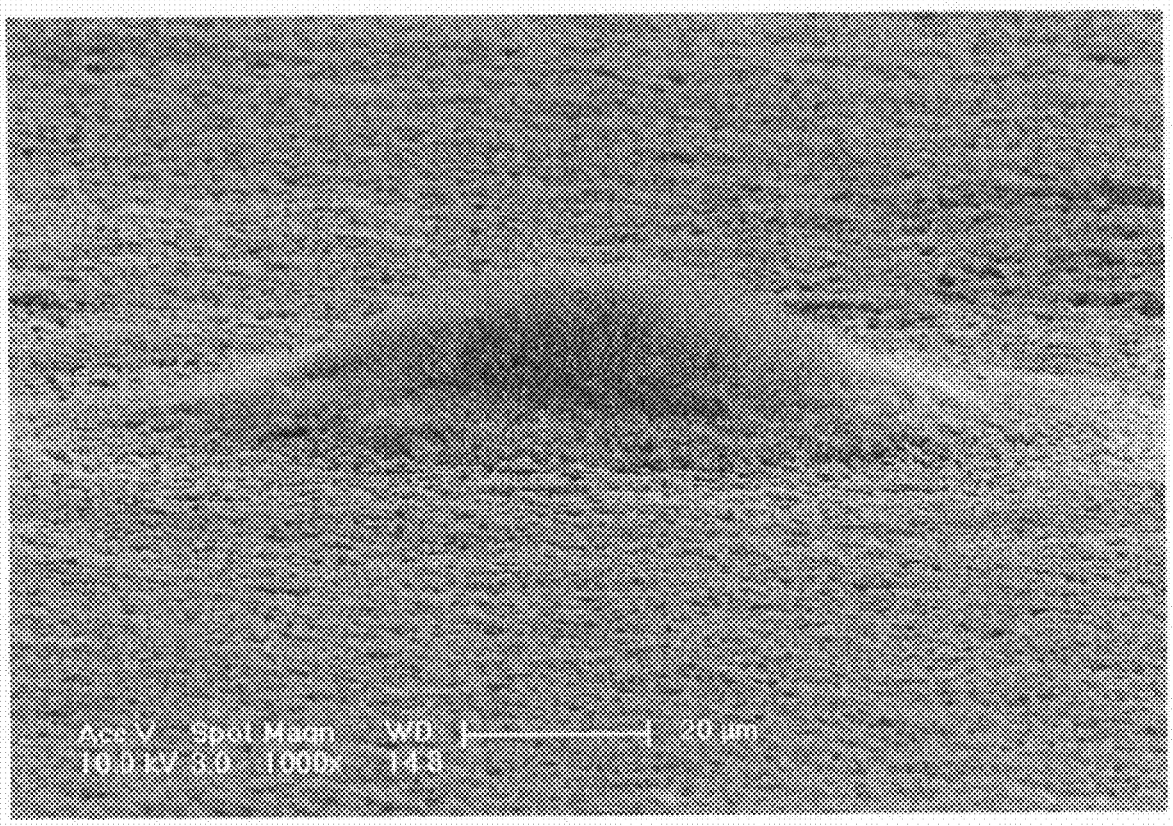
FIG. 3 shows a Scanning Electron Microscope (SEM) image of the array of carbon nanotubes formed/grown by the method of FIG. 1, wherein the catalyst film includes the first carbonaceous material.

Referring to FIG. 3, an array of carbon nanotubes manufactured by the present method is shown. The catalyst film includes the first carbonaceous material. The array of carbon nanotubes is synthesized by irradiating the focused laser beam on the second surface of the substrate for about 5 seconds. The formed array of carbon nanotubes, in this example, manifests a hill-shaped morphology. The diameter of the hill is in the approximate range from 50 to 80 micrometers. The maximum height of the hill is in the approximate range from 10 to 20 micrometers. The diameter of each of carbon nanotubes is in the approximate range from 40 to 80 nanometers.

Figure 4:
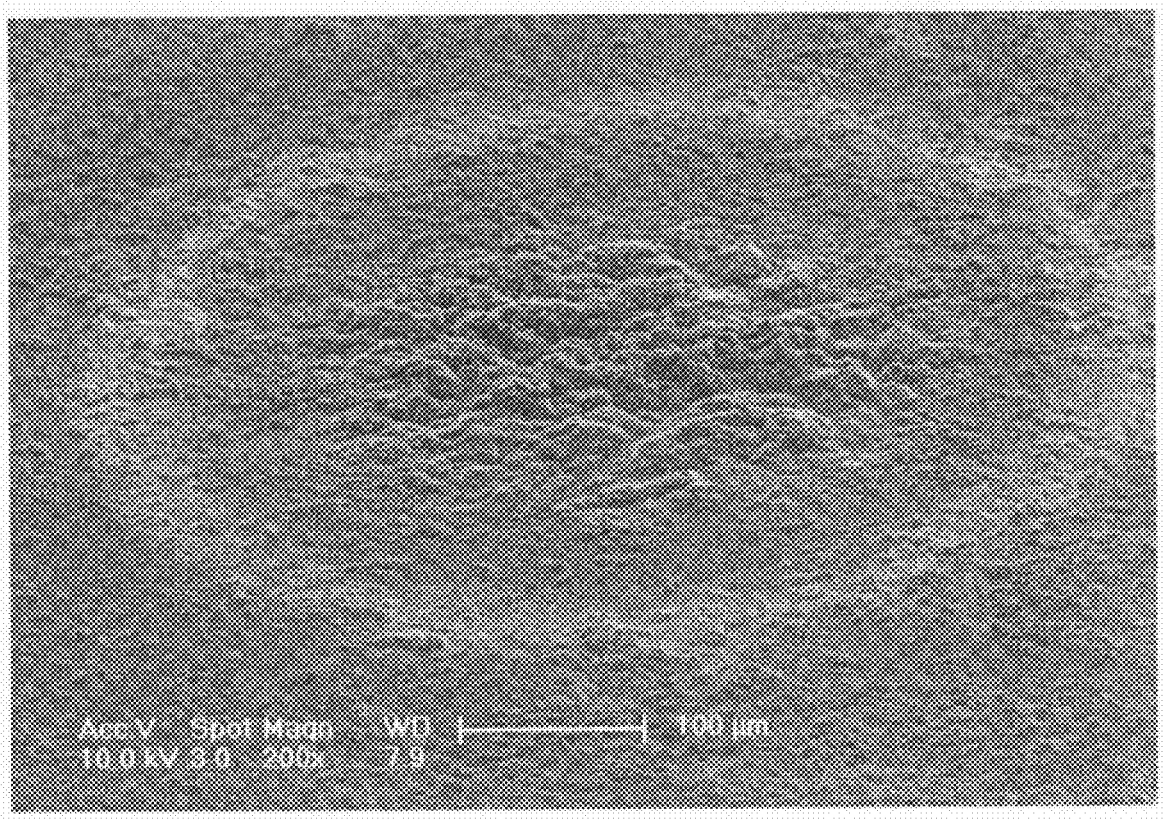
FIG. 4 shows a Scanning Electron Microscope (SEM) image of the array of carbon nanotubes formed/grown by the method of FIG. 1 wherein a step (f) of forming a light absorption layer is further provided before step (b), and the catalyst film is formed on the light absorption material on the first surface of the substrate.

Referring to FIG. 4, another array of carbon nanotubes manufactured by the present method is shown. A light absorption layer made by commercially colloidal graphite is formed between the catalyst film and the substrate. The array of carbon nanotubes is synthesized by irradiating the focused laser beam on the second surface of the substrate for about 30 seconds. The formed array of carbon nanotubes, in this example, manifests a hill-shaped morphology. The diameter of the hill is in the approximate range from 100 to 200 μm. The maximum height of the hill is in the approximate range from 10 to 20 μm. The diameter of each of carbon nanotubes is in the approximate range from 10 to 30 nanometers.

It is noted that, the present method can synthesize a large area array of carbon nanotubes by scanning the laser beam on a large area substrate and that the properties of carbon nanotubes thus produced are able to be closely controlled and thereby be essentially uniform.

Compared with conventional CVD methods for growing arrays of carbon nanotubes, the method in the present embodiments employs a semiconductor laser system to grow carbon nanotubes thereby having the following virtues. Firstly, comparing with conventional lasers used in CVD methods for growing carbon nanotubes, the semiconductor laser used in the present invention has the following advantages, such as a small size, a high-coupling frequency, a rapid response speed, a wavelength and size of the semiconductor laser adapting to the size of optical fiber, directly modulating, and a good coherence, etc. Thus the manufacturing cost of carbon nanotube arrays is low, and the properties of the carbon nanotubes can be closely controlled. Secondly, the wavelength of the laser generated by the semiconductor laser is shorter than that generated by the traditional gas laser, and the laser beam generated by the semiconductor laser has the square-wave distribution, so the laser beam generated by the semiconductor laser is beneficial to flashly heat up the substrate and the catalyst. Thirdly, because the catalyst layer and/or the light absorption layer used in the present embodiments will be able to absorb laser beam and thereby promote heating up the catalyst to enable carbon nanotube growth, the present method for growing arrays of carbon nanotubes can proceed in open air, without a closed reactor and/or vacuum conditions. That is, the operation is relatively simple and the cost of the present method is low compared to conventional methods.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A method for growing an array of carbon nanotubes, comprising the steps of:

(a) providing a substrate having a first surface and a second surface opposite to the first surface;

(b) forming a catalyst film comprised of catalyst material and carbonaceous light absorbing material on the first surface of the substrate;

(c) flowing a mixture of a carrier gas and a carbon source gas over the catalyst film;

(d) providing a semiconductor laser system to generate a focused laser beam; and (e) irradiating the focused laser beam on the substrate to grow the array of the carbon nanotubes on the substrate.

2. The method as claimed in claim 1, wherein the semiconductor laser system comprises at least one laser diode and at least one multi-model optical fiber coupling therewith.

3. The method as claimed in claim 2, wherein a diameter of focused laser beam is in the approximate range from 50 to 200 micrometers.

4. The method as claimed in claim 2, wherein a diameter of the multi-model optical fiber is in the approximate range from 20 to 100 micrometers.

5. The method as claimed in claim 2, wherein a power of laser diode is in the approximate range from 1 to 10 Watts.

6. The method as claimed in claim 1, wherein a wavelength of laser beam is in the approximate range from 700 to 1300 nanometers.

7. The method as claimed in claim 1, wherein the semiconductor laser system further comprises at least one lens for focusing the laser beam.

8. The method as claimed in claim 1, wherein the focused laser beam irradiates on the catalyst film on the first surface of the substrate directly.

9. The method as claimed in claim 8, wherein the substrate is comprised of a material selected from a group consisting of silicon, silicon oxide, and a metal.

10. The method as claimed in claim 1, wherein the focused laser beam irradiates on the second surface of the substrate.

11. The method as claimed in claim 10, wherein the substrate is comprised of a material selected from a group consisted of a glass, and a plastic organic material.

12. The method as claimed in claim 1, wherein step (b) further comprises the substeps of:

(b1) providing a mixture of a dispersant and the carbonaceous light absorbing material;

(b2) combining the mixture with a solvent to form a solution;

(b3) ultrasonically agitating the solution to promote dispersing of the the carbonaceous light absorbing material therein;

(b4) adding a soluble catalyst material into the dispersed solution to form a catalyst solution;

(b5) coating the catalyst solution on the first surface of the substrate; and (b6) baking the substrate to form a catalyst film including the carbonaceous light absorbing material on the first surface of the substrate.

* * * * *